US007374455B2

(12) United States Patent
Purdy et al.

(10) Patent No.: US 7,374,455 B2
(45) Date of Patent: May 20, 2008

(54) CONNECTOR ASSEMBLY FOR A CABLE HAVING A RADIALLY FACING CONDUCTIVE SURFACE AND METHOD OF OPERATIVELY ASSEMBLING THE CONNECTOR ASSEMBLY

(75) Inventors: Eric Purdy, Constantia, NY (US); Noah Montena, Syracuse, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 0 days.

(21) Appl. No.: 11/583,494

(22) Filed: Oct. 19, 2006

(65) Prior Publication Data

US 2008/0096419 A1 Apr. 24, 2008

(51) Int. Cl.
*H01R 9/05* (2006.01)

(52) U.S. Cl. ..... 439/578; 439/585

(58) Field of Classification Search ..... 439/578, 439/585

See application file for complete search history.

(56) References Cited

U.S. PATENT DOCUMENTS

| | | | | |
|---|---|---|---|---|
| 2,036,769 | A | 4/1936 | Kleinmann | |
| 4,099,825 | A * | 7/1978 | Jackson | 439/188 |
| 4,491,685 | A * | 1/1985 | Drew et al. | 174/75 C |
| 5,435,745 | A * | 7/1995 | Booth | 439/584 |
| 5,518,420 | A | 5/1996 | Pitschi | |
| 5,653,615 | A | 8/1997 | Inaba et al. | |
| 5,795,188 | A * | 8/1998 | Harwath | 439/583 |
| 5,893,782 | A | 4/1999 | Harting et al. | |
| 6,133,532 | A * | 10/2000 | Lundback et al. | 174/88 C |
| 6,293,824 | B1 * | 9/2001 | Guerin et al. | 439/583 |
| D460,414 | S | 7/2002 | Suzuki | |
| 6,568,964 | B2 | 5/2003 | D'Addario | |
| 6,590,478 | B2 | 7/2003 | Pluymers | |
| 6,626,710 | B1 | 9/2003 | Tsai Huang | |
| 6,634,906 | B1 * | 10/2003 | Yeh | 439/585 |
| 6,705,875 | B2 | 3/2004 | Berghorn et al. | |
| 6,729,912 | B2 | 5/2004 | D'Addario | |
| 6,736,674 | B2 | 5/2004 | Korte et al. | |
| 6,824,415 | B2 * | 11/2004 | Wlos | 439/348 |
| 6,882,242 | B2 * | 4/2005 | Nelson | 333/35 |
| 6,926,555 | B2 * | 8/2005 | Nelson | 439/578 |
| 7,029,323 | B1 * | 4/2006 | Petersen et al. | 439/578 |
| 7,029,326 | B2 * | 4/2006 | Montena | 439/585 |
| 2005/0181667 | A1 | 8/2005 | Kao | |

FOREIGN PATENT DOCUMENTS

| | | |
|---|---|---|
| GB | 2195500 | 4/1988 |

* cited by examiner

*Primary Examiner*—Tulsidas C. Patel
*Assistant Examiner*—Harshad C Patel
(74) *Attorney, Agent, or Firm*—Wood, Phillips, Katz, Clark & Mortimer

(57) ABSTRACT

The combination of an elongate cable and a connector assembly. The elongate cable has a central axis and a receptacle with a radially inwardly facing conductive surface. A body on the connector assembly has an insert portion with a wall having a radially inwardly facing surface and a radially outwardly facing conductive surface. A first connector is in electrical contact with the radially outwardly facing conductive surface on the wall. The insert portion is extended into the receptacle on the cable. A biasing assembly is configured to produce a resilient radial force on the wall of the connector assembly so as to maintain the radially outwardly facing conductive surface of the wall in electrical contract with the radially inwardly facing conductive surface of the elongate cable to thereby maintain a conductive path between the radially inwardly facing conductive surface on the elongate cable and the first connector.

33 Claims, 7 Drawing Sheets

CONNECTOR ASSEMBLY FOR A CABLE HAVING A RADIALLY FACING CONDUCTIVE SURFACE AND METHOD OF OPERATIVELY ASSEMBLING THE CONNECTOR ASSEMBLY

BACKGROUND OF THE INVENTION

1. Field of the Invention

This invention relates to connectors for elongate cables and, more particularly, to a connector assembly through which a connector on the connector assembly is placed in electrical contact with a radially inwardly facing conductive surface on the cable.

2. Background Art

Larger sizes of coaxial cable are commonly made with hollow center conductors. The center conductors may be formed as thin walled tubes and commonly have annular corrugations thereon to facilitate bending. By reason of including the corrugations, it may be difficult to establish a reliable electrical contact with the radially inwardly facing conductive surface on the center conductor. Positive maintenance of this electrical contact is critical to establishing a high integrity connection between a connector, such as a pin connector, and the center conductor. This has prompted the development of a number of alternative designs for connector assemblies, amongst which is that which uses a dart-tipped, or barbed, probe that is forcibly directed into the center conductor at the cable end. To be effective, this type of connection generally requires deformation of the center conductor and the maintenance of a constant holding force. This holding force may, due to environmental variations, such as temperature changes, and other changed conditions, relax over the anticipated useful life of the connector assembly.

In another form, the connector assembly has a flexible, slotted tube that is inserted within the center conductor. The slots separate the tube to define discrete fingers that are urged against the radially inwardly facing conductive surface. By using a thicker wall on these tubes, positive holding forces can be developed between the tube fingers and center conductor, at the cost of limiting compliance of the tubes/fingers to the radially inwardly facing, conductive, center conductor surface. This is particularly true where the radially inwardly facing, conductive, center conductor surface is corrugated.

The latter problem can be eliminated to a certain extent by making the tube/fingers more flexible and compliant to irregular surfaces. However, by doing so, the holding forces, resulting from the residual forces in the "loaded" fingers, may be relatively weak, and prone to diminishing further over time.

The industry continues to seek out connecting structures at these sites that establish good contact to maximize electrical transmission properties, while at the same time maintaining a secure and positive connection over the anticipated useful life of the product.

SUMMARY OF THE INVENTION

In one form, the invention is directed to the combination of an elongate cable and a connector assembly. The elongate cable has a central axis and a receptacle with a radially inwardly facing conductive surface. The connector assembly has a body with a central axis. The body has an insert portion with a wall having a radially inwardly facing surface and a radially outwardly facing conductive surface. A first connector is in electrical contact with the radially outwardly facing conductive surface on the wall. The insert portion is extended into the receptacle on the cable. A biasing assembly is configured to produce a resilient radial force on the wall of the connector assembly so as to maintain the radially outwardly facing conductive surface of the wall in electrical contract with the radially inwardly facing conductive surface of the elongate cable to thereby maintain a conductive path between the radially inwardly facing conductive surface on the elongate cable and the first connector.

In one form, the elongate cable is a coaxial cable with a center conductor defining the radially inwardly facing conductive surface.

In one form, the wall extends around the central axis of the body so as to define diametrically opposite wall portions. The biasing assembly is configured to produce a biasing force between the diametrically opposite wall portions.

The biasing assembly may be in the form of a resilient component.

In one form, the resilient component has a body with a cylindrical portion that engages the diametrically opposite wall portions.

In one form, the body has a discrete finger that is deflectable in a radial direction, with the biasing assembly in the form of a component that is in axial coincidence with the discrete finger and configured to exert a radial outward force on the discrete finger.

In one form, the body has a base portion and the discrete finger is connected to, and projects in cantilever fashion from, the base portion.

In one form, the body has axially spaced, annular corrugations.

In one form, at least one of the axially spaced, annular corrugations is provided on the discrete arm.

In one form, the body has a plurality of discrete fingers that are deflectable in a radial direction. The fingers are spaced around the central axis of the body and cooperatively define a cylindrical shape. The biasing assembly is configured to produce a radial force on a plurality of the discrete fingers.

In one form, the discrete fingers are each connected to and project from, the base portion.

In one form, the biasing assembly is in the form of a resilient component with a cylindrical portion. The cylindrical portion engages a plurality of the discrete fingers within the receptacle.

In one form, the resilient component has a spherical shape.

The first connector may be a pin connector.

In one form, the wall extends around a space. The biasing assembly is in the form of a component with a first portion that resides within the space and a sealing portion that is spaced axially from the first portion. The sealing portion seals against the radially inwardly facing conductive surface.

In one form, the radially inwardly facing conductive surface may have at least one annular corrugation.

The radially inwardly facing conductive surface may have a plurality of axially spaced corrugations, with the sealing portion having a plurality of axially spaced, annular projections that are complementary to the shape of the radially inwardly facing conductive surface.

In one form, the connector assembly is formed as one piece.

Alternatively, the connector assembly may be made from a plurality of parts that are operatively engaged and maintained in operative relationship by moving the plurality of parts axially, one relative to the other.

The above structure may be further provided in combination with a second connector assembly having a second connector that is coaxial with and surrounds the first connector.

The above structure may be further provided in combination with a connector fitting with threads configured to maintain the first and second connector assemblies operatively connected to a port with threads complementary to the threads on the connector fitting.

The elongate cable may have a corrugated, annular, conductive surface that is in electrical contact with the second connector.

In one form, the biasing assembly has a resilient component made from a compressible material and that is separate from and attached to, and maintained upon, the body without requiring use of separate fasteners.

The invention is further directed to the combination of an elongate cable and a connector assembly. The elongate cable has a central axis and a receptacle with a radially inwardly facing conductive surface. The connector assembly has a body with an insert portion with a wall having a radially inwardly facing surface and a radially outwardly facing conductive surface, and a first connector in electrical contact with the radially outwardly facing conductive surface on the wall. The insert portion extends into the receptacle. Resilient biasing structure is provided within the receptacle for producing a radial force on the wall so as to maintain the radially outwardly facing conductive surface of the wall in electrical contact with the radially inwardly facing conductive surface on the elongate cable to thereby maintain a conductive path between the radially inwardly facing conductive surface on the elongate cable and the first connector.

In one form, the resilient biasing structure is in the form of a resilient biasing component made from a compressible material and that has at least a portion that is at least one of: a) cylindrical; and b) spherical with a central axis that is coaxial with the central axis of the body.

In one form, the body has discrete structure on the wall deflecting radially outwardly under a force produced by the resilient biasing structure for maintaining the radially outwardly facing conductive surface in electrical contact with the radially inwardly facing conductive surface on the elongate cable.

In one form, the resilient component is separate from, and attached to, and maintained upon, the body without requiring use of separate fasteners.

The invention is further directed to a connector assembly for a coaxial cable having a hollow center conductor with a central axis and defining a receptacle. The connector assembly has a body having a central axis and including an insert portion with a wall having a radially inwardly facing surface and a radially outwardly facing conductive surface, and a first connector in electrical contact with the radially outwardly facing conductive surface on the wall. The insert portion is configured to be extended into the receptacle on the center conductor on the coaxial cable. A biasing assembly is configured to produce a resilient, radial force on the wall so as to maintain the radially outwardly facing conductive surface of the wall in electrical contact with a radially inwardly facing conductive surface on the hollow center conductor on the coaxial cable to thereby maintain a conductive path between the radially inwardly facing conductor surface on the hollow center conductor on the coaxial cable and the first connector.

In one form, the biasing assembly comprises a resilient component that is separate from, and attached to, and maintained upon, the body without requiring use of separate fasteners.

The biasing assembly may be in the form of a resilient component made from a compressible material.

The resilient compound may have at least a portion that is at least one of: a) cylindrical; and b) spherical.

The invention is further directed to a method of operatively assembling a connector assembly to an elongate cable having a central axis and a receptacle with a radially inwardly facing conductive surface. The method includes the step of providing a connector assembly having a body with a central axis and an insert portion with a wall having a radially inwardly facing surface and a radially outwardly facing conductive surface, and a first connector in electrical contact with the radially outwardly facing conductive surface on the wall. The invention further includes the steps of: providing a biasing component; extending the insert portion into the receptacle; and joining the connector assembly and biasing component by moving the connector assembly and biasing component axially, one relative to the other, so that: a) simply by reason of relatively axially moving the connector assembly and biasing component, the connector assembly and biasing component are maintained together without requiring any separate fastener; and b) the biasing component produces a resilient radial force on the wall so as to maintain the radially outwardly facing conductive surface of the wall in electrical contact with the radially inwardly facing conductive surface on the elongate cable to thereby maintain a conductive path between the radially inwardly facing conductive surface on the elongate cable and the first connector.

In one form, the step of providing a biasing component involves providing a biasing component that has at least a portion thereof that is shaped as one of: a) a cylinder; and b) a sphere with a central axis coaxial with the central axis of the body.

DETAILED DESCRIPTION OF THE DRAWINGS

Figure 1:
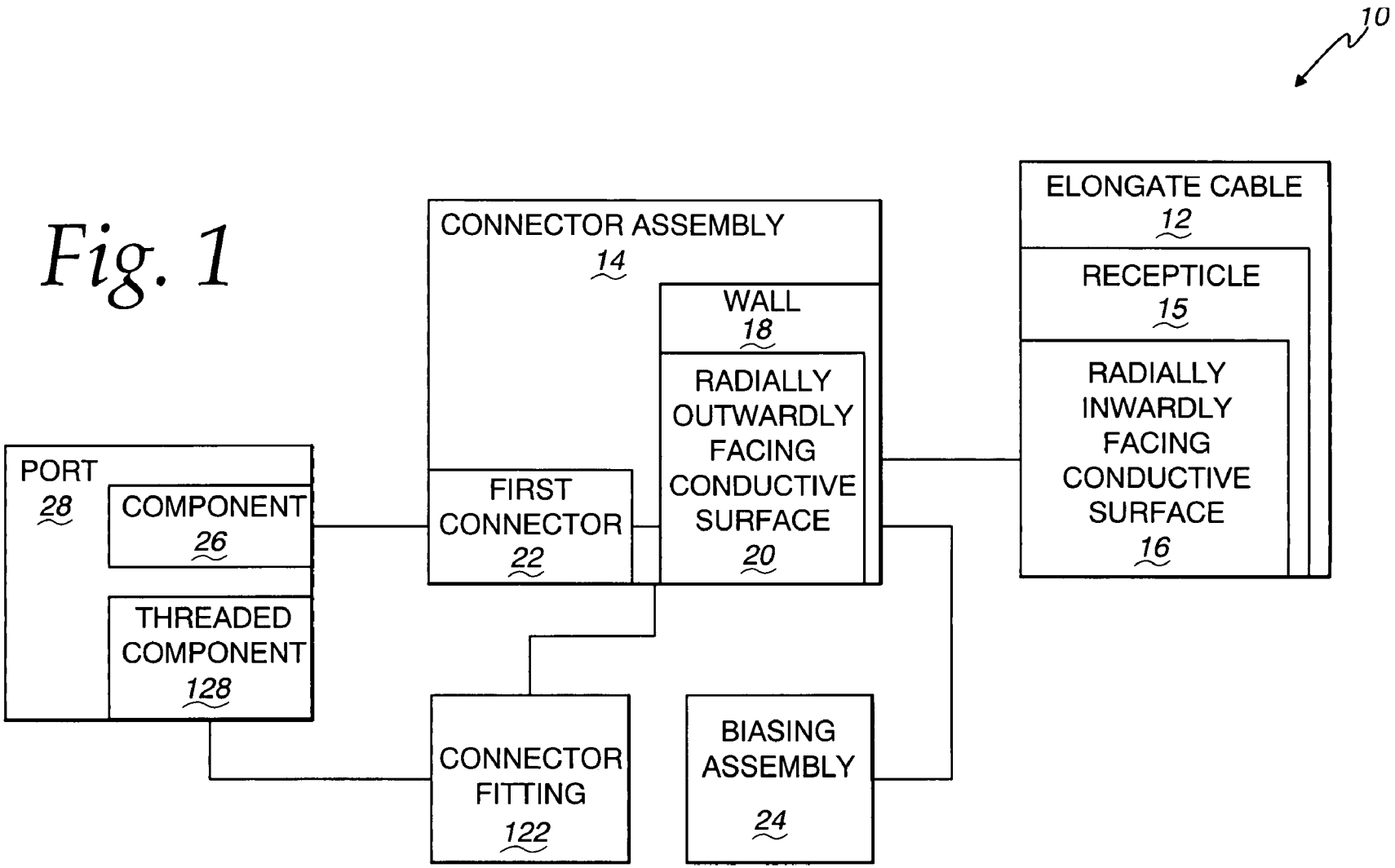
FIG. 1 is a schematic representation of a combination, according to the present invention, including a connector assembly, an elongate cable, and a port, with the connector assembly having a wall with a radially outwardly facing conductive surface that, through a biasing assembly, is urged into electrical contact with a radially inwardly facing conductive surface on the elongate cable.
Figure 2:
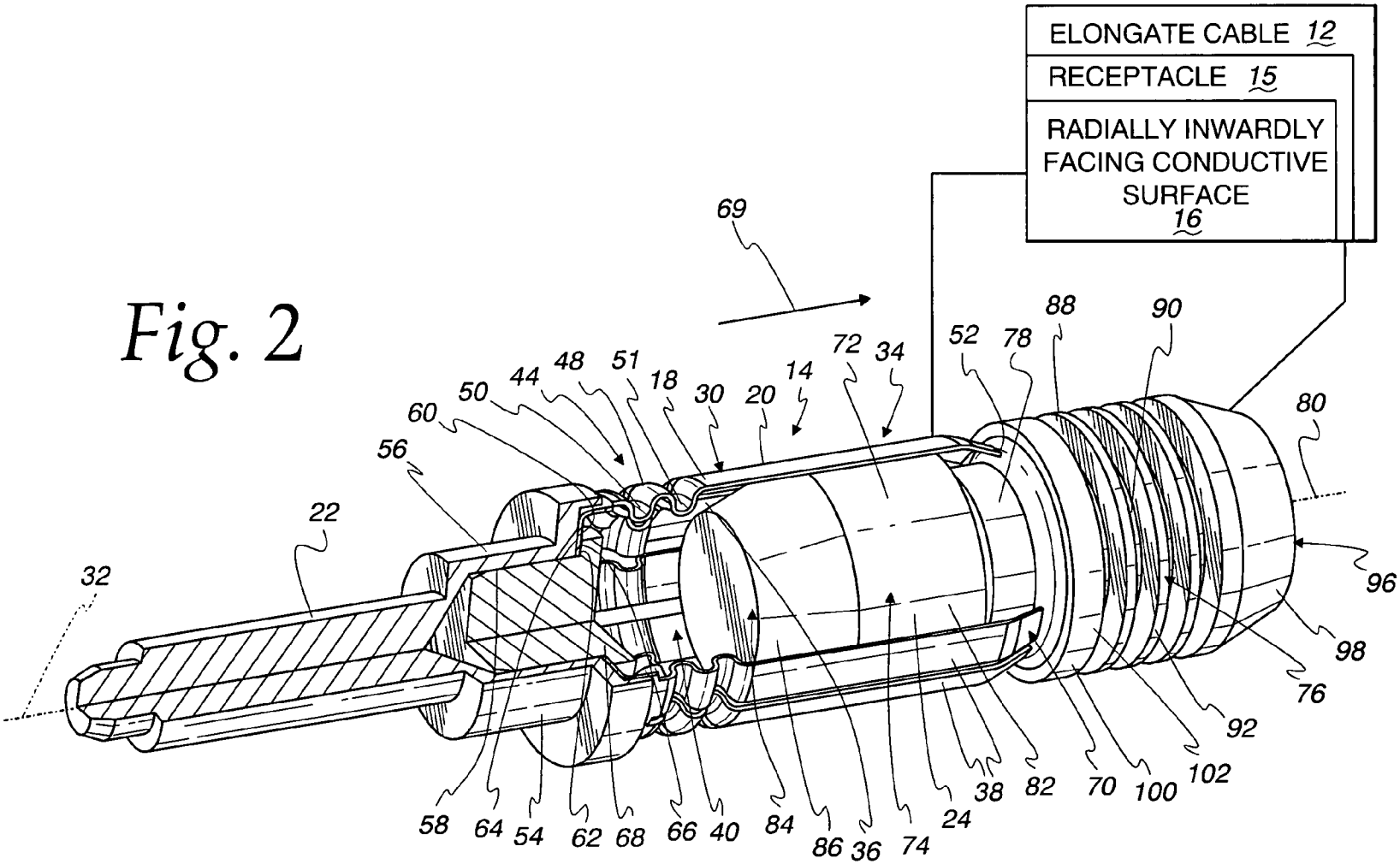
FIG. 2 is a partially schematic, perspective view of an exemplary form of connector assembly and biasing assembly, as in FIG. 1 and according to the present invention, in assembled relationship, and with a portion of the connector assembly broken away to reveal a part of the biasing assembly.
Figure 3:
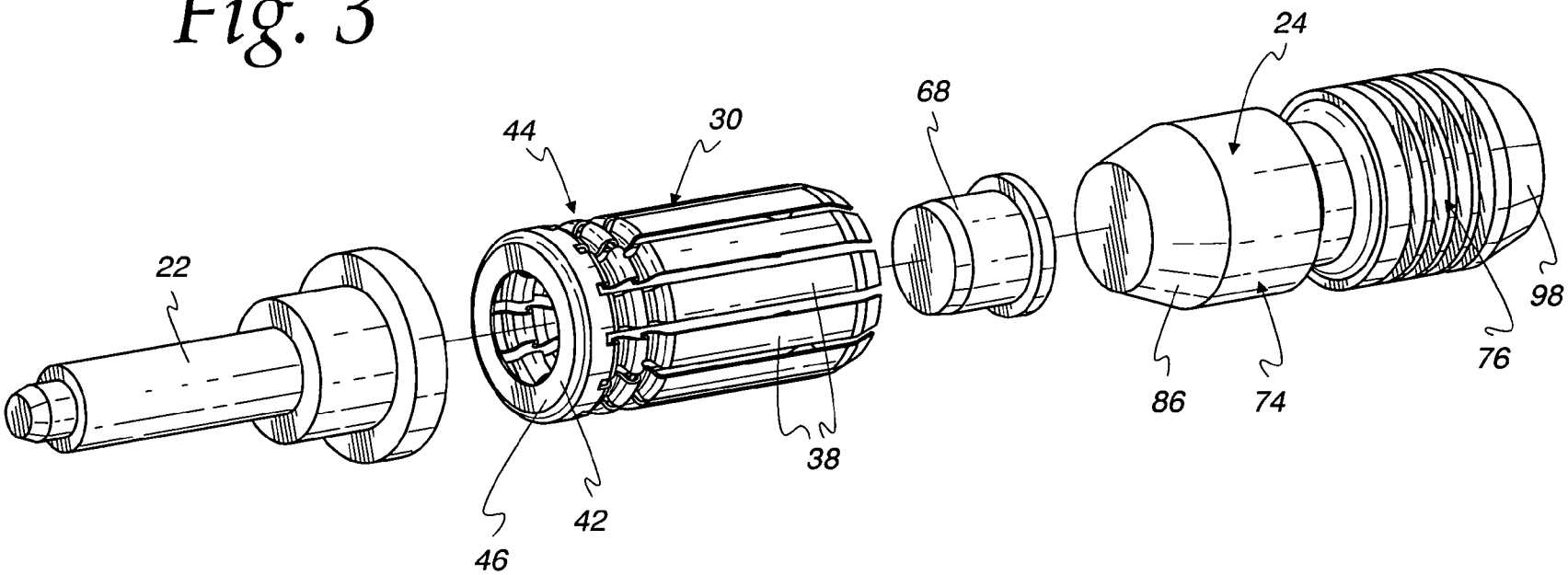
FIG. 3 is an exploded perspective view of the components in FIG. 2.
Figure 4:
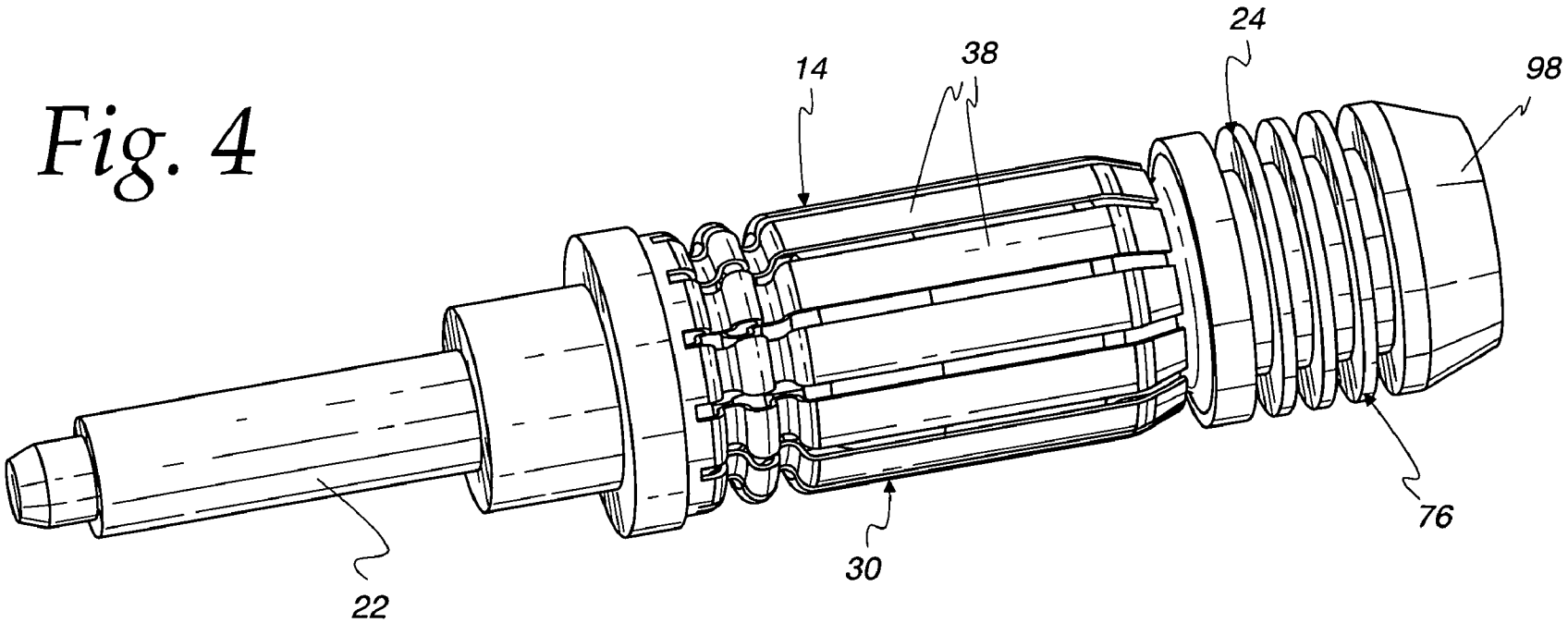
FIG. 4 is a view as in FIG. 2 without the portion of the connector assembly broken away.
Figure 5:
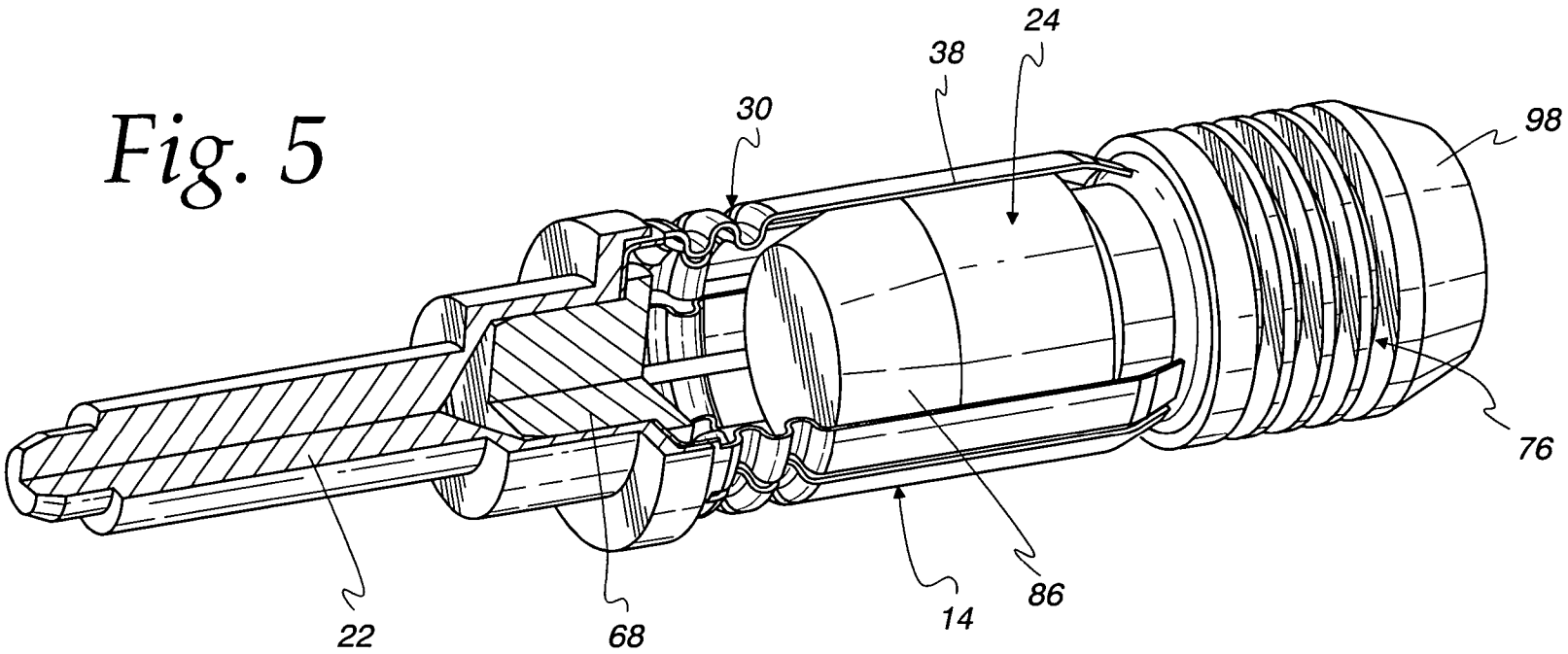
FIG. 5 is a view as in FIG. 2 from a slightly different perspective.

In FIG. 1, a combination of elements according to the present invention, is shown schematically at 10. The combination 10 includes an elongate cable 12 with which a connector assembly 14 cooperates. The elongate cable 12 has a central axis and a receptacle 15 bounded by a radially inwardly facing conductive surface 16. The connector assembly 14 has a central axis and a wall 18 having a radially outwardly facing conductive surface 20. The connector assembly 14 further has a first connector 22 in electrical contact with the radially outwardly facing conductive surface 20 on the wall 18. A portion of the wall 18 extends into the receptacle 15.

A biasing assembly 24 is configured to produce a resilient, radial force on at least a part of the wall 18 so as to maintain the radially outwardly facing conductive surface 20 on the wall 18 in electrical contact with the radially inwardly facing conductive surface 16 on the elongate cable 12, to thereby maintain a conductive path between the radially inwardly facing conductive surface on the elongate cable and the first connector 22.

The first connector 22 may be any type of connector, such as a pin connector, that is electrically connected to a component 26 on a port 28. The port 28 is intended to generically describe any "fitting", whether a terminal fitting, a cable end fitting, etc., that can be placed in electrical contact with the radially inwardly facing conductive surface 16 on the elongate cable 12 through the first connector 22.

The combination 10 is shown in FIG. 1 in schematic form since the various elements shown lend themselves to being made in virtually a limitless number of structurally different forms. For example, the nature of the port 28, and the first connector 22 that is connected thereto through the component 26, is not limited to any particular structure that is known or may be devised. Further, the elongate cable 12 may be any of a number of different cables, currently offered, among which is a coaxial cable. The components are shown schematically preparatory to showing specific embodiments of the invention, to emphasize that the invention has a more generic scope than is demonstrated by the specific exemplary embodiments hereinbelow described.

Referring now to FIGS. 2-6, one specific form of the connector assembly 14 is shown. The connector assembly 14 has a cylindrical body 30 with a central axis 32. The body 30 has an insert portion 34, of which the wall 18 is a part. The wall 18 has a radially inwardly facing surface 36 and the aforementioned radially outwardly facing conductive surface 20. The wall 18 is defined by a plurality of discrete, elongate, axially extending fingers 38 which cooperatively produce a cylindrical shape bounding a space 40.

The body 30 includes an annular base portion 42. The fingers 38 are connected to, and project in cantilever fashion from, the base portion 42. The lengths of the fingers 38 project generally parallel to the axis 32. The fingers 38 are equidistantly spaced from each other in a circumferential direction.

The body 30 has annular corrugations at 44 adjacent to a first axial end 46 of the body 30 where the fingers 38 connect to the base portion 42. The corrugations 44 are annular, axially spaced elements and, in this embodiment, consist of an annular ridge 48 between adjacent annular grooves 50, 51. At least one, and in this case a plurality, of the corrugations 144 are provided on the fingers 38. The corrugations 44 supplement the inherent flexibility of the fingers 38 to allow bending of the body 30 relative to the axis 32 and also facilitate flexing of the free ends 52 of the fingers 38, remote from the first axial end 46 of the body 30, in a radial direction, both inwardly and outwardly relative to the axis 32. Any number of corrugations 44 may be provided along the length of the body 30.

In the embodiment shown, the base portion 42 and fingers 38 are made as one piece from a thin sheet of formable, bendable, conductive material. The material is chosen so that with the configuration shown, the individuals fingers 38 can be conformed along substantial portions of the lengths thereof to the radially inwardly facing conductive surface 16 on the elongate cable 12, shown with a uniform diameter in FIG. 6 at 16, or alternatively with a corrugated configuration at 16', in FIG. 7. This pliancy is facilitated by both the inherent bendability of the material as well as the inclusion of the corrugations at 44 and the cantilevered mounting of the fingers 38.

In the embodiment shown in FIGS. 2-6, the first connector 22 is in the form of a pin connector with a stepped diameter body 54. The body 54 has a thickened portion 56 with a stepped, blind bore 58 that defines an annular, axially facing shoulder 60 which seats the first axial end 46 of the body 30. The body 30 has a radially inturned, annular flange 62 with one surface 64, facing in one axial direction, that bears against the shoulder 60. The surface 66 of the flange 62, facing axially oppositely to the one surface 64, is borne upon by a headed fastener insert 68 that is friction fit to be maintained within the bore 58, thereby to secure the body 30 and first connector 22 together as a unitary assembly that is movable at all times as one piece. The uniting of the body 30 and first connector 22 can be effected by directing the headed fastener insert 68 axially through the space 40 and into the bore 58 to thereby captively secure the flange 62.

The body 38 can be configured so that the radially outwardly facing conductive surface 20, defined cooperatively by the fingers 38, has a diameter that is slightly greater than that of the radially inwardly facing conductive surface 16 on the elongate cable 12. By directing the insert portion 34 of the body 30 on the connector assembly 14 into the receptacle 15, axially in the direction of the arrow 69, the fingers 38 become slightly deformed radially inwardly so that there is a residual bias force urging the fingers 38 radially to against the radially inwardly facing conductive surface 16 on the elongate cable 16, to establish positive electrical contact therewith. To facilitate this introduction of the connector assembly 14 into the receptacle 15, the free ends 52 of the fingers 38 are slightly bent radially inwardly to cooperatively produce an inclined, annular guide surface 70. Aside from facilitating coaxial alignment between the generally cylindrical/annular receptacle 15 and the body 30, the guide surface 70 also progressively bends the fingers 38 during assembly to effect radial loading thereof.

As noted previously, in the Background portion herein, in the absence of any additional structure, the fingers 38, as described above, may lose some of their resilience or may become permanently deformed under the constant radial pressure imparted thereto by the annular conductive surface 16. This may cause a break in the electrical connection between the first connector 22 and cable 12.

According to the invention, the biasing assembly 24 avoids this condition to assure that positive electrical contact is maintained between the body 30 and the conductive surface 16 of the elongate cable 12, thereby to assure that a consistent conductive path is maintained between the elongate cable 12 and first connector 22. The biasing assembly 24, in one form, is shown to have a body 72 with a first portion 74 that resides within the space 40, and a sealing portion 76, formed integrally and preferably as one piece, with the first portion 74, and axially offset therefrom. The first portion 74 and sealing portion 76 are joined by a reduced diameter neck portion 78.

The biasing assembly 24 has a generally overall cylindrical shape 24 with a central axis 80 coincident with both the central axis 32 of the body 30 and the central axis of the elongate cable 12. The first portion 74 has a cylindrical portion 82 of substantially uniform diameter that conformingly nests within the space 40. The cylindrical portion 82 has a diameter that is chosen so that with the connector assembly 14 inserted within the receptacle 15, the cylindrical portion 82 of the body 72 produces a resilient, radial outward, bias force upon some, and preferably all, of the fingers 38, to maintain intimate contact between the radially outwardly facing conductive surface 20 on the body 30 and the radially inwardly facing conductive surface 16 on the elongate cable 12.

The first portion 74 may take a variety of different shapes. At a minimum, it is preferred that the first portion 74 be compressed between diametrically opposite wall portions/fingers 38 to produce a constant, radially opposite, outward force thereupon. Preferably, the parts are relatively configured so that upon directing the connector assembly 14 into the receptacle 15, the fingers 38 deform radially inwardly to compress the body 72. The residual forces therein produce the radial outward force on the fingers 38 on the connector assembly 14. Preferably, the residual forces in the body 72 urge all of the fingers 38 radially outwardly into electrical contact with the radially inwardly facing conductive surface 16, to thereby maintain a conductive path between the radially inwardly facing conductive surface 16 and the first connector 22 through the conductive body 30.

While the body 72 could be made from a substantially rigid material, it is preferred that it be resilient and compressible, such as from rubber, or other material that gives under the forces encountered during assembly and as the connector assembly 14 is bent. The body 72 thus serves as a resilient biasing means for producing a radial force on the wall 18 so as to maintain electrical contact between the radially outwardly facing conductive surface 20 of the wall 18 and the radially inwardly facing conductive surface 16 of the elongate cable 12. The fingers 38 in turn function as a discrete means on the wall 18 that deflect radially under a force produced by the body 72 within the receptacle 15 to maintain electrical contact between the surfaces 16, 20.

To facilitate assembly of the biasing assembly 24 and body 30, one axial end 84 of the first portion 74 has a truncated, conical shape, defining an inclined surface 86. By directing the biasing assembly 24 from right to left in exemplary FIG. 2, the guide surface 86 encounters the finger free ends 52. Continued axial movement progressively biases the free ends 52 of the fingers 38 away from each other whereby the cylindrical portion 82 of the body 72 can be wedged into the space 40. With the cylindrical portion 82 fully seated in the base 40, the free ends 52 of the fingers 38 can relax radially inwardly to seat in the region of the neck portion 78, thereby releasably axially capturing the cylindrical portion 82.

Figure 7:
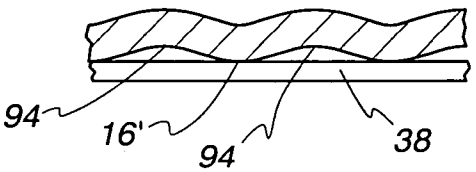
FIG. 7 is a view as in FIG. 6 wherein the radially inwardly facing conductive surface is corrugated.
Figure 6:
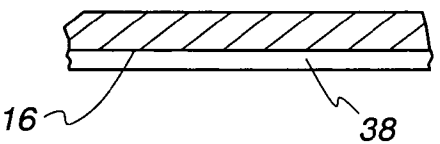
FIG. 6 is an enlarged, fragmentary, cross-sectional view of a radially inwardly facing conductive surface on an elongate cable with a finger on the connector assembly in electrical contact therewith.

The sealing portion 76, which is optional, aside from facilitating grasping and manipulation of the biasing assembly 24 as during assembly/disassembly, serves also as a sealing component against the conductive surface 16 on the elongate cable 12. The sealing portion 76 has a generally cylindrical shape with axially alternating annular ribs 88 and grooves 90. The outer, radially outwardly facing annular surfaces 92 of the ribs 88 can be radially compressed and placed sealingly against the conductive surface 16 of the elongate cable 12. Alternatively, with the radially inwardly facing conductive surface 16' in FIG. 7, the ribs 88 can be configured to move within radially inwardly opening grooves 94, as seen in FIG. 7. In either event, the seal between the sealing portion 76 and radially inwardly facing conductive surface 16, 16' can be established by moving the sealing portion 76 and elongate cable 12 axially relative to and against each other.

With the described construction, the connector assembly 14 and biasing assembly 24 can be placed in operative relationship simply by moving the same from an axially separated state axially towards and against each other. The surface 86 progressively cams the free ends 52 of the fingers 38 away from each other to allow direction of the first portion 74 into the space 40, whereupon the finger free ends 52 spring back to releasably maintain the first portion 74 within the space 40. This connection is essentially a snap-fit connection that can be releasably maintained without the requirement of any separate fasteners. Thereafter, the pre-assembled connector assembly 14 and biasing assembly 24 can be moved as a unit axially, in the direction of the arrow 69, to extend the sealing portion 76 into the receptacle 15. This is facilitated by making the axial end 96 of the biasing assembly 24, opposite to the axial end 84, with a truncated conical shape with an angled guide surface 98. The guide surface 98 facilitates centering of the sealing portion 76 into coaxial relationship within the receptacle 15 and also permits progressive squeezing of the sealing portion 76 as it is extended into the receptacle 15. With the sealing portion 76 fully seated, an annular rib 100, with an annular sealing surface 102 having a greater axial extent than that of the surfaces 92, resides at least partially within the receptacle 15 to engage the conductive surface 16.

Figure 8:
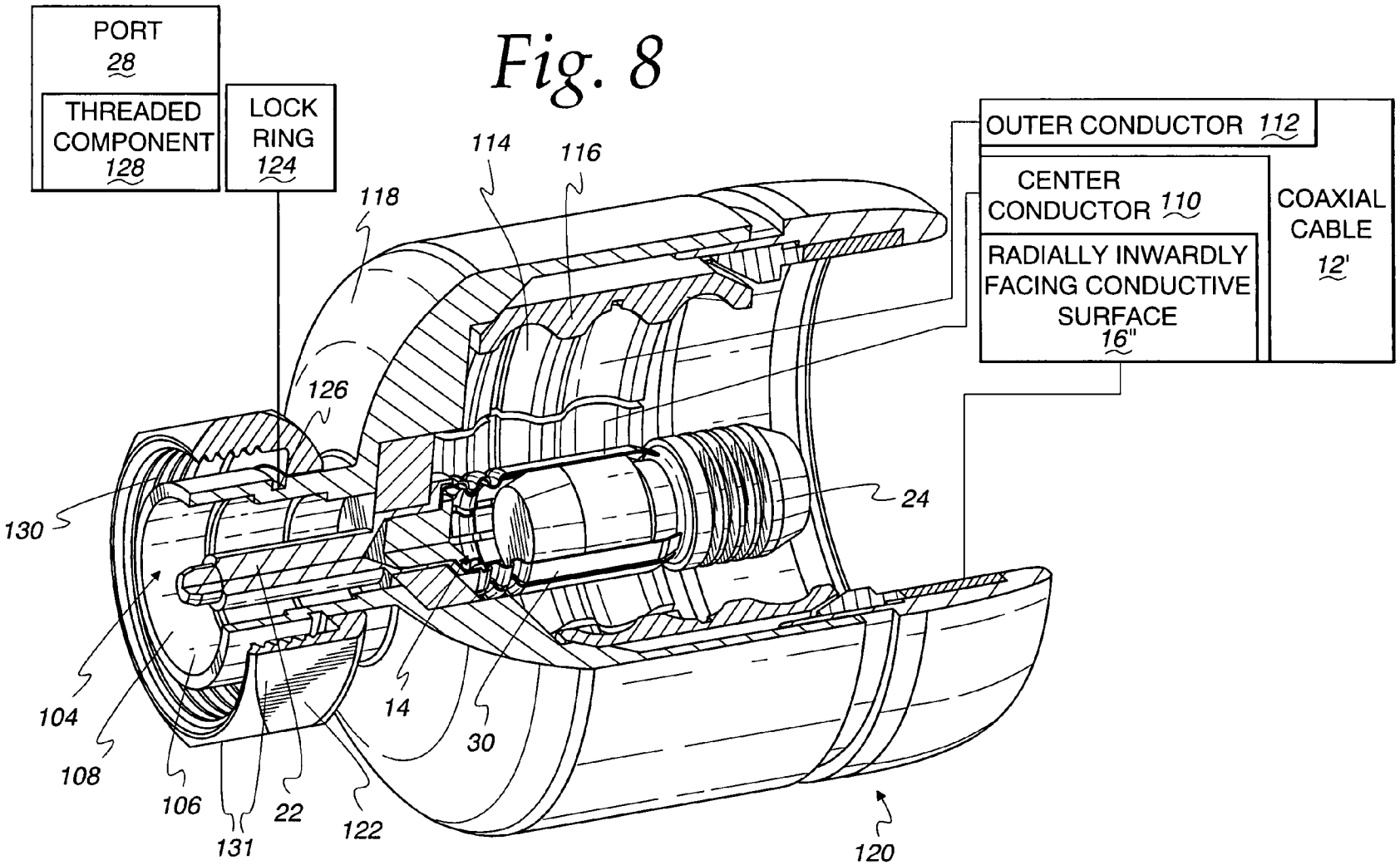
FIG. 8 is a partially broken away, perspective view of a system, according to the invention, in which the connector assembly and biasing assembly in FIGS. 2-7 are integrated into an assembly through which center and outer conductors on a coaxial cable are electrically connected to a port.

In FIG. 8, the connector assembly 14 with the operatively connected biasing assembly 24 is shown in turn operatively connected with a second connector assembly 104. The second connector assembly 104 consists of a second connector 106 with a conductive, annular surface 108 that is coaxial with, and surrounds, the first connector 22.

The configuration of the structure shown in FIG. 8 is designed particularly for a coaxial cable 12' with a hollow center conductor 110 that defines an annular, radially inwardly facing conductive surface 16" that is placed in electrical contact with the body 30, as described above. The surface 16" may be cylindrical or corrugated.

The coaxial cable 12' has an outer conductor 112 that may be cylindrical or corrugated, with the latter shown as in FIG. 8 to be in electrical contact with a complementary conductive surface 114 on a sleeve 116, that is in electrical contact with a cylindrical wall 118 that terminates at the second connector 106. Through a securing assembly at 120, the same general type as described in U.S. Pat. No. 6,153,830, which is incorporated herein by reference, the coaxial cable 12' is mechanically fixed with respect to the sleeve 116 and wall 118. Details of how this structure and others might mechanically and electrically connect to the coaxial cable 12', other than at the connector assembly 14, are peripheral to the present invention. Thus, details thereof will not be described herein.

The structure shown in FIG. 8 is attachable to the port 28, for operative connection therewith, through a connector fitting 122, that in this case surrounds the second connector 106 and is rotatable relative thereto. A lock ring 124 fits in a groove 126 on the connector 106 to block axial movement of the connector fitting 122 from the operative position shown in FIG. 8, while allowing the connector fitting 122 to be guidingly rotated relative to the second connector 106.

The port 28 has a threaded component 128 that cooperates with threads 130 on the connector fitting 122 to releasably secure the components in FIG. 8 to the port 28. The outside of the connector fitting 122 has flats 131 that cooperatively produce a polygonal shape to be engaged by a conventional wrench.

The invention contemplates variations to the basic structure, as described above. As just one example, the connector assembly 14 is shown in FIGS. 2-8 to include multiple parts 22, 30, 68. One or more of these parts could be combined, with potentially the entire connector assembly 14 made as one piece, as encompassed within the generic showing of FIG. 1.

Figure 9:
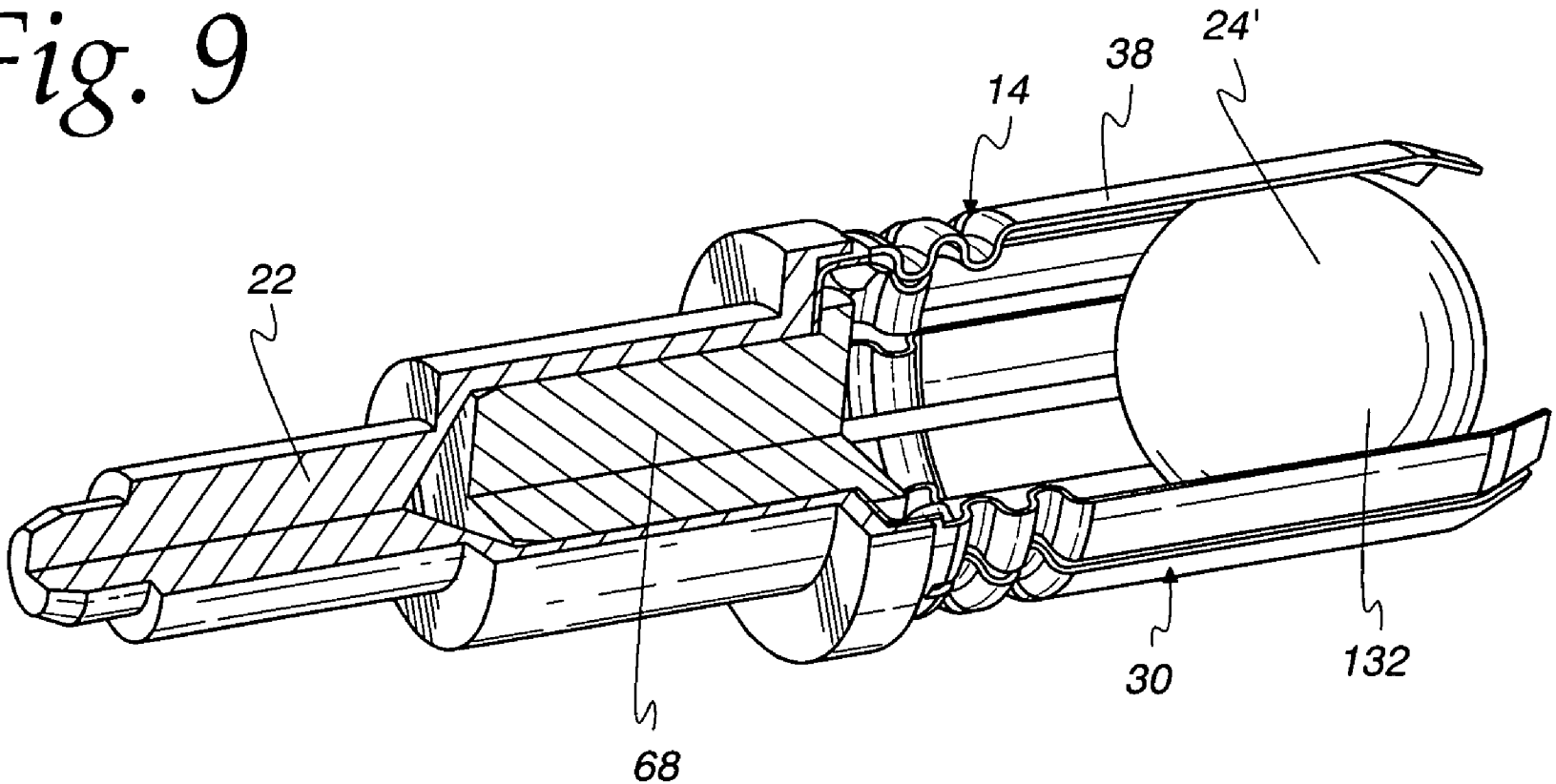
FIG. 9 is a view as in FIG. 2 with a modified form of sealing assembly, in the form of a spherical component.

In FIG. 9, the connector assembly 14 is shown with a modified form of biasing assembly 24', in the form of a spherical component 132. The spherical component 132 has a diameter selected to approximate that of the cylindrical portion 82 of the first portion 74 of the biasing assembly, previously described. Thus, the spherical component 132 can be considered to be annular/cylindrical in nature and performs the same function as the prior embodiment of the biasing assembly 24 in substantially the same way, using point contact with each of the fingers 38 around its circumference.

The foregoing disclosure of specific embodiments is intended to be illustrative of the broad concepts comprehended by the invention.

The invention claimed is:

1. In combination:

a) an elongate cable having a central axis and a receptacle with a radially inwardly facing conductive surface; and b) a connector assembly comprising:

a body having a central axis and comprising: i) an insert portion with a wall having a radially inwardly facing surface and a radially outwardly facing conductive surface; and ii) a first connector in electrical contact with the radially outwardly facing conductive surface on the wall, the insert portion extended into the receptacle; and a biasing assembly configured to produce a resilient radial outward force against the radially inwardly facing surface of the wall so as to maintain the radially outwardly facing conductive surface of the wall in electrical contact with the radially inwardly facing conductive surface on the elongate cable to thereby maintain a conductive path between the radially inwardly facing conductive surface on the elongate cable and the first connector.

2. In combination:

a) an elongate cable having a central axis and a receptacle with a radially inwardly facing conductive surface; and b) a connector assembly comprising:

a body having a central axis and comprising: i) an insert portion with a wall having a radially inwardly facing surface and a radially outwardly facing conductive surface; and ii) a first connector in electrical contact with the radially outwardly facing conductive surface on the wall, the insert portion extended into the receptacle; and a biasing assembly configured to produce a resilient radial force on the wall so as to maintain the radially outwardly facing conductive surface of the wall in electrical contact with the radially inwardly facing conductive surface on the elongate cable to thereby maintain a conductive path between the radially inwardly facing conductive surface on the elongate cable and the first connector, wherein the elongate cable comprises a coaxial cable with a center conductor defining the radially inwardly facing conductive surface.

3. The combination according to claim 2 wherein the wall extends around the central axis of the body so as to define diametrically opposite wall portions and the biasing assembly is configured to produce a biasing force between the diametrically opposite wall portions.

4. The combination according to claim 3 wherein the biasing assembly comprises a resilient component.

5. The combination according to claim 4 wherein the resilient component has a body with a cylindrical portion that engages the diametrically opposite wall portions.

6. In combination:

a) an elongate cable having a central axis and a receptacle with a radially inwardly facing conductive surface; and b) a connector assembly comprising:

a body having a central axis and comprising: i) an insert portion with a wall having a radially inwardly facing surface and a radially outwardly facing conductive surface; and ii) a first connector in electrical contact with the radially outwardly facing conductive surface on the wall, the insert portion extended into the receptacle; and a biasing assembly configured to produce a resilient radial force on the wall so as to maintain the radially outwardly facing conductive surface of the wall in electrical contact with the radially inwardly facing conductive surface on the elongate cable to thereby maintain a conductive path between the radially inwardly facing conductive surface on the elongate cable and the first connector, wherein the body comprises a discrete finger that is deflectable in a radial direction and the biasing assembly comprises a component that is in axial coincidence with the discrete finger and configured to exert a radial outward force on the discrete finger.

7. The combination according to claim 6 wherein the body has a base portion and the discrete finger is connected to, and projects in cantilever fashion from, the base portion.

8. The combination according to claim 1 wherein the body comprises axially spaced, annular, corrugations.

9. The combination according to claim 8 wherein at least one of the axially spaced, annular corrugations is provided on the discrete arm.

10. The combination according to claim 6 wherein the body comprises a plurality of discrete fingers that: a) are deflectable in a radial direction; b) spaced around the central axis of the body; and c) cooperatively define a cylindrical shape, and the biasing assembly is configured to produce a radial force on a plurality of the discrete fingers.

11. The combination according to claim 10 wherein the body has a base portion and the plurality of discrete fingers are connected to and project from, the base portion.

12. The combination according to claim 10 wherein the biasing assembly comprises a resilient component that has a body with a cylindrical portion that engages a plurality of the discrete fingers within the receptacle.

13. The combination according to claim 4 wherein the resilient component has a spherical shape.

14. The combination according to claim 2 wherein the first connector is a pin connector.

15. In combination:

a) an elongate cable having a central axis and a receptacle with a radially inwardly facing conductive surface; and b) a connector assembly comprising:

a body having a central axis and comprising: i) an insert portion with a wall having a radially inwardly facing surface and a radially outwardly facing conductive surface; and ii) a first connector in electrical contact with the radially outwardly facing conductive surface on the wall, the insert portion extended into the receptacle; and a biasing assembly configured to produce a resilient radial force on the wall so as to maintain the radially outwardly facing conductive surface of the wall in electrical contact with the radially inwardly facing conductive surface on the elongate cable to thereby maintain a conductive path between the radially inwardly facing conductive surface on the elongate cable and the first connector, wherein the wall extends around a space and the biasing assembly comprises a component with a first portion that resides within the space and a sealing portion that is spaced axially from the first portion, the sealing portion sealing against the radially inwardly facing conductive surface.

16. The combination according to claim 1 wherein the radially inwardly facing conductive surface has at least one annular corrugation.

17. The combination according to claim 15 wherein the radially inwardly facing conductive surface has a plurality of axially spaced corrugations and the sealing portion has a plurality of axially spaced, annular projections that are complementary to a shape of the radially inwardly facing conductive surface.

18. The combination according to claim 1 wherein the connector assembly is formed as one piece.

19. The combination according to claim 1 wherein the connector assembly comprises a plurality of parts that are operatively engaged and maintained in operative relationship by moving the plurality of parts axially, one relative to the other.

20. The combination according to claim 2 further in combination with a second connector assembly comprising a second connector that is coaxial with and surrounds the first connector.

21. The combination according to claim 20 further in combination with a connector fitting with threads configured to maintain the first and second connector assemblies operatively connected to a port having threads complementary to the threads on the connector fitting.

22. The combination according to claim 20 wherein the elongate cable has a corrugated, annular, conductive surface that is in electrical contact with the second connector.

23. The combination according to claim 1 wherein the biasing assembly comprises a resilient component made from a compressible material and that is separate from and attached to and mounted upon the body without requiring use of separate fasteners.

24. In combination:

a) an elongate cable having a central axis and a receptacle with a radially inwardly facing conductive surface; and b) a connector assembly comprising:

a body having a central axis and comprising: i) an insert portion with a wall having a radially inwardly facing surface and a radially outwardly facing conductive surface; and ii) a first connector in electrical contact with the radially outwardly facing conductive surface on the wall, the insert portion extended into the receptacle; and resilient biasing means within the receptacle for producing a radial outward force against the radially inwardly facing surface of the wall so as to maintain the radially outwardly facing conductive surface of the wall in electrical contact with the radially inwardly facing conductive surface on the elongate cable to thereby maintain a conductive path between the radially inwardly facing conductive surface on the elongate cable and the first connector.

25. The combination according to claim 24 wherein the resilient biasing means comprises a resilient component made from a compressible material and that has at least a portion that is at least one of: a) cylindrical; and b) spherical with a central axis that is coaxial with the central axis of the body.

26. In combination:

a) an elongate cable having a central axis and a receptacle with a radially inwardly facing conductive surface; and b) a connector assembly comprising:

a body having a central axis and comprising: i) an insert portion with a wall having a radially inwardly facing surface and a radially outwardly facing conductive surface; and ii) a first connector in electrical contact with the radially outwardly facing conductive surface on the wall, the insert portion extended into the receptacle; and resilient biasing means within the receptacle for producing a radial force on the wall so as to maintain the radially outwardly facing conductive surface of the wall in electrical contact with the radially inwardly facing conductive surface on the elongate cable to thereby maintain a conductive path between the radially inwardly facing conductive surface on the elongate cable and the first connector, wherein the body comprises discrete means on the wall for deflecting radially outwardly under a force produced by the resilient biasing means within the receptacle for maintaining the radially outwardly facing conductive surface in electrical contact with the radially inwardly facing conductive surface on the elongate cable.

27. The combination according to claim 25 wherein the resilient component is separate from and attached to and maintained upon the body without requiring use of separate fasteners.

28. A connector assembly for a coaxial cable having a center conductor with a central axis and defining a receptacle, the connector assembly comprising:

a body having a central axis and comprising: i) an insert portion with a wall having a radially inwardly facing surface and a radially outwardly facing conductive surface; and ii) a first connector in electrical contact with the radially outwardly facing conductive surface on the wall, the insert portion configured to be extended into a receptacle on a center conductor on a coaxial cable; and a biasing assembly configured to produce a resilient, radial outward force against the radially inwardly facing surface of the wall so as to maintain the radially outwardly facing conductive surface of the wall in electrical contact with a radially inwardly facing conductive surface on a hollow center conductor on a coaxial cable to thereby maintain a conductive path between a radially inwardly facing conductive surface on a hollow center conductor on a coaxial cable and the first connector.

29. The connector assembly according to claim 28 wherein the biasing assembly comprises a resilient component that is separate from and attached to and maintained upon the body without requiring use of separate fasteners.

30. The connector assembly according to claim 28 wherein the biasing assembly comprises a resilient component made from a compressible material.

31. The connector assembly according to claim 30 wherein the resilient component has at least a portion that is at least one of: a) cylindrical; and b) spherical.

32. A method of operatively assembling a connector assembly to an elongate cable having a central axis and a receptacle with a radially inwardly facing conductive surface, the method comprising the steps of:

providing a connector assembly comprising a body having a central axis and comprising: i) an insert portion with a wall having a radially inwardly facing surface and a radially outwardly facing conductive surface; and ii) a first connector in electrical contact with the radially outwardly facing conductive surface on the wall;

providing a biasing component;

extending the insert portion into the receptacle; and joining the connector assembly and biasing component by moving the connector assembly and biasing component axially, one relative to the other so that: a) simply by reason of relatively axially moving the connector assembly and biasing component, the connector assembly and biasing component are maintained together without requiring any separate fastener; and b) the biasing component produces a resilient radial outward force against the radially inwardly facing surface of the wall so as to maintain the radially outwardly facing conductive surface of the wall in electrical contact with the radially inwardly facing conductive surface on the elongate cable to thereby maintain a conductive path between the radially inwardly facing conductive surface on the elongate cable and the first connector.

33. The method according to claim 32 wherein the step of providing a biasing component comprises providing a biasing component that has at least a portion thereof that is shaped as one of: a) a cylinder; and b) a sphere with a central axis coaxial with the central axis of the body.

* * * * *